United States Patent [19]

Martin

[11] 4,103,383

[45] Aug. 1, 1978

[54] SNOW DRAG AND SCOOP

[76] Inventor: Alice I. Martin, 1001 E. 5th, Long Beach, Calif. 90802

[21] Appl. No.: 792,266

[22] Filed: Apr. 29, 1977

[51] Int. Cl.[2] ..... A47L 1/06; A01B 1/22

[52] U.S. Cl. ..... 15/245; 37/53; 294/57

[58] Field of Search ..... 37/41, 50, 53; 294/54, 294/55, 56, 57, 58; 15/236 R, 245; 172/612, 767

[56] References Cited

U.S. PATENT DOCUMENTS

| | | | |
|---|---|---|---|
| 1,450,209 | 4/1923 | Hays | 15/236 R |
| 2,347,963 | 5/1944 | O'Neill | 15/236 R |
| 3,666,020 | 5/1972 | Hess | 37/41 |

*Primary Examiner*—E. H. Eickholt

*Attorney, Agent, or Firm*—William R. Piper

[57] ABSTRACT

A snow drag in which the snow moving member is a sector of a pneumatic semi-resilient tire carcass extending through an arc of about 120°. A transverse section through the tire carcass is arcuate in shape with the outer edge being used as a snow drag and the interior of the carcass functioning as a scoop for gathering the snow. A handle is rigidly secured to the center of the inner edge of the tire carcass sector and radially extending and arcuate reinforcing members are mounted on the exterior and interior arcuate surfaces. These members are arranged in pairs with rivets interconnecting the two members of each pair and extending through the tire carcass. This arrangement permits the tire carcass to have a certain amount of resiliency while still retaining its overall general shape.

2 Claims, 3 Drawing Figures

SNOW DRAG AND SCOOP

SUMMARY OF THE INVENTION

An object of my invention is to provide a snow drag and scoop in which the snow engaging member is made from discarded pneumatic tire carcasses that otherwise would not be used. I have found that each discarded tire carcass can be cut into six equal parts by first cutting it along its mid portion and around its entire circumference to make two circular halves and then cutting each circular half into three equal parts, each part comprising an arcuate sector of 120° in length. I do not want to be limited to any particular size of tire sector.

A further object of my invention is to provide a device of the type described in which a wooden handle has a metal holder connecting it to the tire carcass section and consisting of two parts, an upper part contacting the upper surface of the tire carcass and a lower part contacting the under surface of the carcass. Rivets secure the two parts of the holder together and extend through the carcass so as to connect the carcass to the handle.

DESCRIPTION OF THE PREFERRED EMBODIMENT

Figures 1, 2, 3:
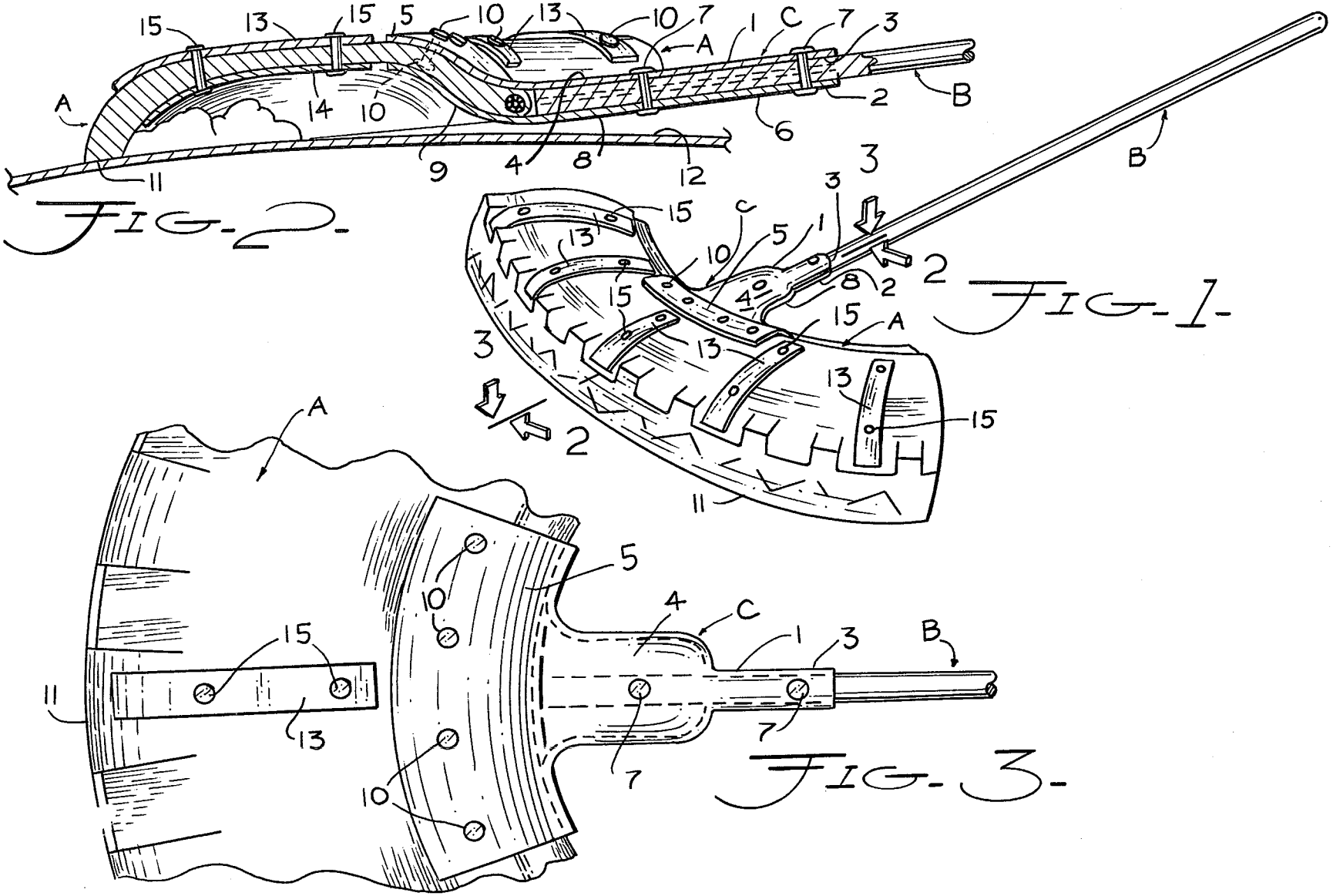
FIG. 1 is a perspective view of the device. The tire carcass sector can have any desired design on its outer surface.
FIG. 2 is an enlarged transverse section through the tire carcass sector and the adjacent portion of the handle and is taken along the line 2—2 of FIG. 1.
FIG. 3 is an enlarged plan view of the central portion of the tire carcass sector and illustrates the holder interconnecting the carcass or snow gathering scoop with the handle.

In carrying out my invention I provide a semi-resilient snow gathering scoop, indicated generally at A, in FIGS. 1 to 3, inclusive, and preferably made from a discarded pneumatic tire carcass section. I have found that a new and novel use can be made of each discarded tire carcass if it is cut along its midportion around its entire circumference to form two circular halves. Then each circular half is cut radially at three points, each 120° apart to form three sectors, each having a length equal to one third of the tire circumference. Discarded tire carcasses are a glut on the market at the present time and they are unsightly as well as forming a fire hazard. My tire sector A provides one outlet for their use and saves the cost of providing new material to make the snow gathering scoop as well as the manufacturing equipment and the labor cost.

I provide a wooden handle B, and connect one end of it to the snow gathering scoop A by a holder C. The holder consists of two parts, an upper part 1 and a lower part 2, see FIG. 2. The upper part 1 may be made of any material desired, such as metal or plastic. This upper part is formed into a half cylindrical portion 3 to receive the handle B. Then this upper part has an outwardly flared mid-portion 4 and an arcuate end portion 5 designed to contact the upper and inner portion of the tire sector A, see both FIGS. 2 and 3. The arcuate portion 5 is also curved in cross section so as to conform to the similarly curved section of the adjacent surface of the tire carcass.

The under part 2 of the holder C that connects the handle B to the snow gathering scoop A, complements the portions 3, 4 and 5 of the upper part 1. Again, FIG. 2 illustrates the under part 2 of the holder. The half cylindrical portion 6 of the under part 2 receives the handle B, and this portion 6 cooperates with the half cylindrical portion 3 of the upper part 1 to form a ferrule that encloses the adjacent end of the handle. Rivets 7, or other suitable fastening means, secures the ferrule to the handle.

The under or lower part 2 of the holder C has an outwardly flared mid-portion 8 similar to and underlying the midportion 4 of the upper part 1. In addition the lower part 2 has an arcuate shaped end portion 9 similar to the arcuate end portion 5 of the upper part. The end portion 9 underlies the inner surface of the tire carcass A and is shaped so as to conform to this surface. Rivets 10, or other suitable fastening means, extend through the arcuate portions 5 and 9 and through the intervening tire carcass portion to bind all three parts together. In this way the handle B, is connected to the tire carcass sector A.

It will be noted from FIGS. 1, 2 and 3, that the outer arcuate edge 11 of the tire carcass sector A, yieldingly contacts with a surface 12 of the top of an automobile or any other surface such as a roof or a side walk, etc., that has collected snow, when the device is in use. The tire carcass sector A may be too resilient and might have a tendency to buckle in the middle when the operator applies pressure on the handle to scoop up the snow. Therefore, I provide reinforcing arcuate metal strips to the outer and inner surfaces of the tire carcass sector. In the present disclosure, I provide five pairs of reinforcing strips although I do not want to be limited to any exact number. In FIG. 2, I illustrate one pair of these reinforcing strips. The outer reinforcing strip 13 is curved in shape to conform to the adjacent tire surface which it contacts. Also, the inner reinforcing strip 14 of the pair is curved in shape to conform to the adjacent under surface of the tire carcass. Rivets 15, or other suitable fastening means, extends through both reinforcing strips 13 and 14 and through the intermediate tire casing for binding them all together. The outer reinforcing strips 13 may be positioned on the tire carcass where ever the design on the tire tread may permit. FIG. 1 shows the central outer reinforcing strip 13 made shorter in length so as not to interfere with the arcuate end portion 5 of the holder C.

My snow drag may be used for any desired purpose although it has been designed for scooping up snow on any surface. The edge 11 of the snow scoop A will not mar the surface of an automobile top over which it is moved because no metal part will contact the surface to scratch it.

I claim:

1. A device of the type described comprising:

(a) a pneumatic tire carcass sector of about one-half the width of a cross section through the carcass and having a length extending substantially through a one hundred and twenty degree arc;

(b) a handle;

(c) a holder interconnecting the handle to the inner arcuate edge of the tire carcass and at the midpoint of this edge, said holder consisting of two complemental parts forming a ferrule secured to said handle and having two arcuate-shaped portions engaging with the adjacent outer and inner surfaces of said carcass and being secured to said carcass;

(d) radially extending and arcuate-shaped reinforcing pairs of strips, the outer strips contacting and conforming to the outer surface of said carcass, and the inner strips underlying the outer strips and conforming to the inner surface of said carcass; and (e) means for securing the pairs of strips to the carcass.

2. The combination as set forth in claim 1: including (a) spacing said arcuate-shaped reinforcing pairs of strips along the arcuate length of said tire carcass, the central pair of arcuate strips being shorter in length than the other pairs of strips so as to provide sufficient space for the arcuate end portions of said holder to contact with the adjacent outer and inner surfaces of said tire carcass;

(b) the means for securing the pairs of reinforcing strips together including rivets that interconnect the strips of each pair and extend through the thickness of the tire carcass.

* * * * *